US011440717B2

(12) United States Patent
Rivera

(10) Patent No.: US 11,440,717 B2
(45) Date of Patent: Sep. 13, 2022

(54) ESPRESSO CARTRIDGE WITH IMPROVED SEALING TO ESPRESSO MACHINE

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 423 days.

(21) Appl. No.: 15/687,138

(22) Filed: Aug. 25, 2017

(65) Prior Publication Data

US 2019/0062025 A1 Feb. 28, 2019

(51) Int. Cl.

| | |
|---|---|
| ***B65D 77/20*** | (2006.01) |
| ***B65D 85/80*** | (2006.01) |
| ***B65D 85/804*** | (2006.01) |

(52) U.S. Cl.

CPC ..... *B65D 77/202* (2013.01); *B65D 85/8043* (2013.01)

(58) Field of Classification Search

CPC ..... B65D 85/8043; B65D 85/804; B65D 85/8046; B65D 77/202; A47J 31/00; A47J 31/18; A47J 31/3623; A47J 31/40; A47J 31/407

See application file for complete search history.

(56) References Cited

U.S. PATENT DOCUMENTS

| | | | | |
|---|---|---|---|---|
| 2012/0225168 | A1* | 9/2012 | Kamerbeek | A47J 31/407 426/112 |
| 2013/0224341 | A1* | 8/2013 | BenDavid | B65D 85/8043 426/112 |
| 2014/0161936 | A1* | 6/2014 | Trombetta | B65D 85/816 426/77 |
| 2014/0199442 | A1 | 7/2014 | Orsi | |
| 2015/0353274 | A1* | 12/2015 | Bisio | B65D 85/8043 277/312 |
| 2016/0039601 | A1* | 2/2016 | Doglioni Majer | A47J 31/407 99/295 |
| 2016/0137402 | A1* | 5/2016 | Talon | B65D 85/8043 99/295 |

FOREIGN PATENT DOCUMENTS

| | | |
|---|---|---|
| WO | WO 2012/137052 A1 | 10/2012 |
| WO | WO 2014/029803 A1 | 2/2014 |

* cited by examiner

*Primary Examiner* — Ericson M Lachica
(74) *Attorney, Agent, or Firm* — IP Strategies

(57) ABSTRACT

An espresso cartridge includes contours under a rim of the espresso cartridge for guiding and sealing the espresso cartridge in an espresso brewing machine. Espresso brewing machines inject a high pressure flow of water heated to near boiling temperature into the espresso cartridge to brew espresso. As a result, a very good seal is required between the espresso cartridge rim and the espresso brewing machine to prevent leaking. The contours includes a first contour which centers the espresso cartridge in the machine and a second contour which is crushed to seal the espresso cartridge to a brewing chamber base.

20 Claims, 4 Drawing Sheets

ESPRESSO CARTRIDGE WITH IMPROVED SEALING TO ESPRESSO MACHINE

BACKGROUND OF THE INVENTION

The present invention relates to home brewed espresso and in particular to an espresso cartridge having contours under a rim of the espresso cartridge for guiding and sealing a cartridge holder and cartridge of an espresso brewing machine.

Many coffee drinkers have a particular like for espresso due to the thick texture and rich flavor. Espresso is brewed by pumping very hot, nearly boiling, water through finely ground coffee beans. Espresso may be made in an espresso machine having a chamber filled with the finely ground coffee beans and tightly closed, or by a machine which accepts pre-packaged espresso cartridges loaded into a brewing chamber. The brewing chambers capture the espresso cartridge between a chamber base and chamber lid. Unfortunately, because of the high water pressure used to brew espresso, the brewing chambers may leak.

BRIEF SUMMARY OF THE INVENTION

The present invention addresses the above and other needs by providing an espresso cartridge includes contours under a rim of the espresso cartridge for guiding and sealing the espresso cartridge in an espresso brewing machine. Espresso brewing machines inject a high pressure flow of water heated to near boiling temperature into the espresso cartridge to brew espresso. As a result, a very good seal is required between the espresso cartridge rim and the espresso brewing machine to prevent leaking. The contours includes a first contour which centers the espresso cartridge in the machine and a second contour which is crushed to seal the espresso cartridge to a brewing chamber base.

In accordance with one aspect of the invention, there is provided a sealing contour under the rim of the espresso cartridge. The sealing contour meets with a raised edge of a brewing chamber base. The raised edge crushes the sealing contour to form a tight seal.

In accordance with another aspect of the invention, there is provided a centering contour under the rim of the espresso cartridge. The centering contour centers the espresso cartridge in the brewing chamber base. The centering accurately aligns the sealing contour with the raised edge of the brewing chamber base.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
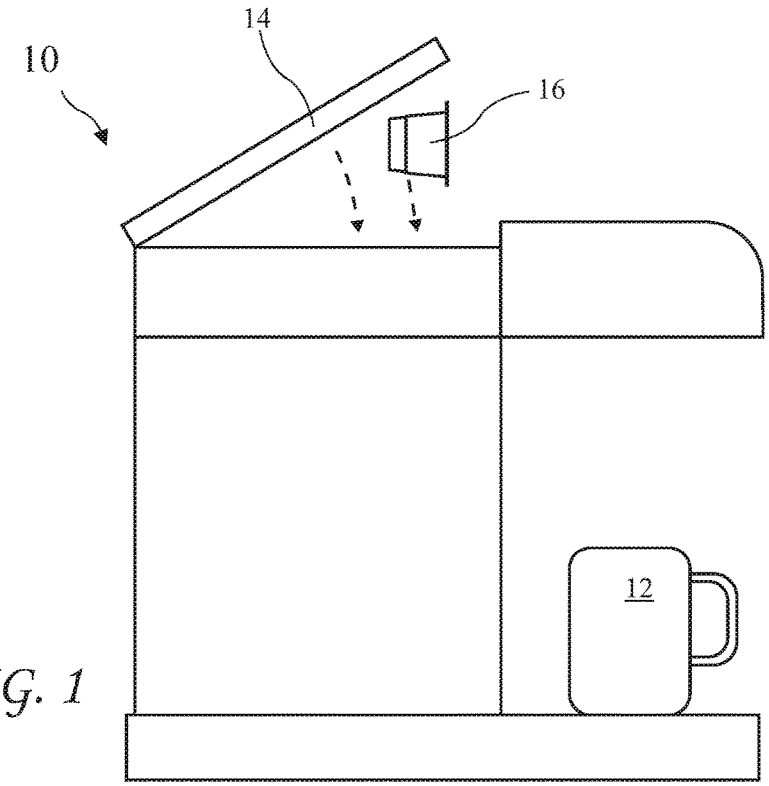
FIG. 1 shows placement of an espresso cartridge according to the present invention in an espresso machine.
Figure 2A:
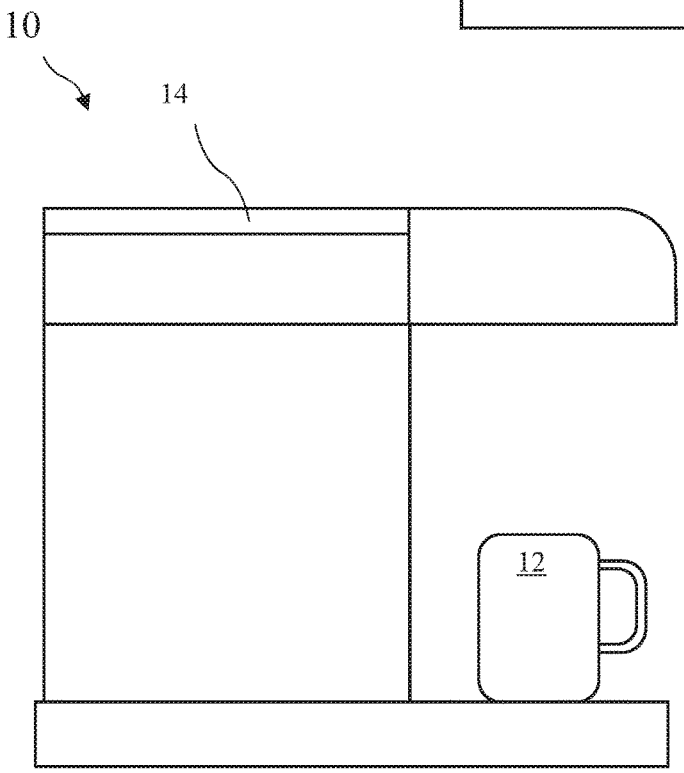
FIG. 2A shows a side view of the espresso machine.
Figure 2B:
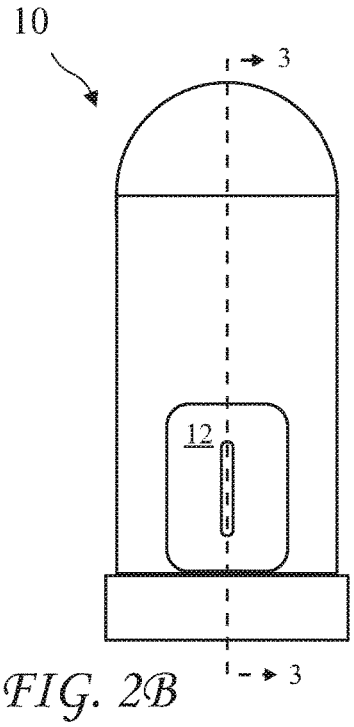
FIG. 2B shows a front view of the espresso machine.

An espresso cartridge 16 according to the present invention is shown ready for insertion into an espresso machine 10 in FIG. 1, a side view of the espresso machine 10 is shown in FIG. 2A, and a front view of the espresso machine 10 is shown in FIG. 2B. A cup or mug 12 is shown positioned to receive espresso from the espresso machine. Generally, a lid 14 of the espresso machine 10 is opened and the espresso cartridge 16 in inserted into a brewing chamber 18 (see FIG. 3) of the espresso machine 10 for brewing the espresso.

Figure 3:
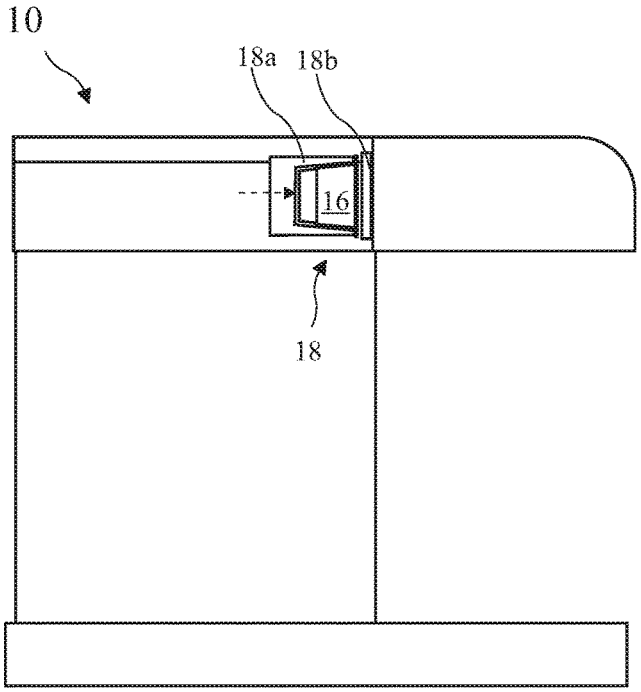
FIG. 3 shows the espresso cartridge according to the present invention in a brewing chamber of the espresso machine.
Figure 4:
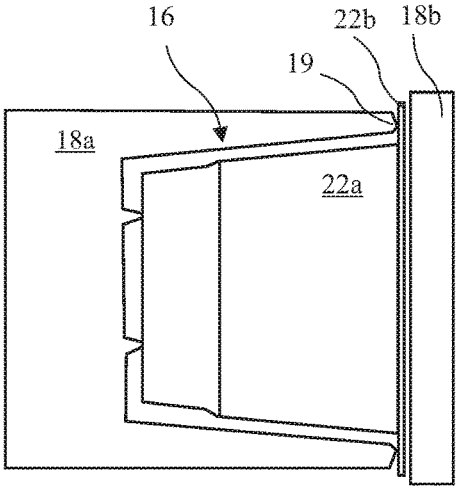
FIG. 4 (prior art)
FIG. 4 shows a prior art espresso cartridge in the brewing chamber.

The espresso cartridge 16 is shown in the brewing chamber 18 of the espresso machine 10 in FIG. 3 and a more detailed view of the prior art espresso cartridge 16 is shown in the brewing chamber 18 in FIG. 4. The espresso cartridge 16 includes a cartridge base 22*a* and cartridge lid 22*b* and resides on its side and is captured between a brewing chamber base 18*a* and brewing chamber cap 18*b*. When the brewing chamber is closed, needles 26*a* and 26*b* (see FIG. 7) enter the espresso cartridge 16 to inject high pressure heated water into the espresso cartridge 16 and receive the brewed espresso from the espresso cartridge 16. A flat rim 22' forms a closed circumference around the lid 22*b* of the espresso cartridge 16 and is captured between a raised edge 19 of the brewing chamber base 18*a* and brewing chamber cap 18*b* to seal the brewing chamber 18.

Figure 5:
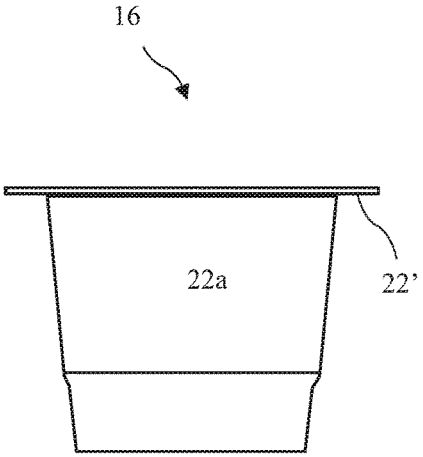
FIG. 5 (prior art)
FIG. 5 shows a side view of the prior art espresso cartridge.
Figure 6:
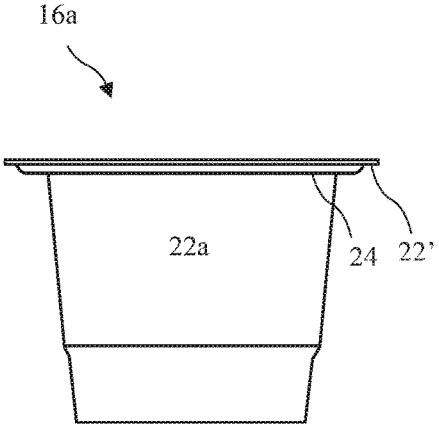
FIG. 6 shows an espresso cartridge according to the present invention.

A side view of the prior art espresso cartridge 16 is shown in FIG. 5 and a side view of an espresso cartridge 16*a* according to the present invention is shown in FIG. 6. The espresso cartridge 16*a* is similar to the prior art espresso cartridge 16 but includes a contour 24 on a bottom surface of the rim 22'. The contour 24 preferably forms a closed circumferential ring circling the bottom surface of the rim 22', and is preferably aligned with the raised edge 19 of the brewing chamber base 18*a* as the brewing chamber closes.

Figure 7:
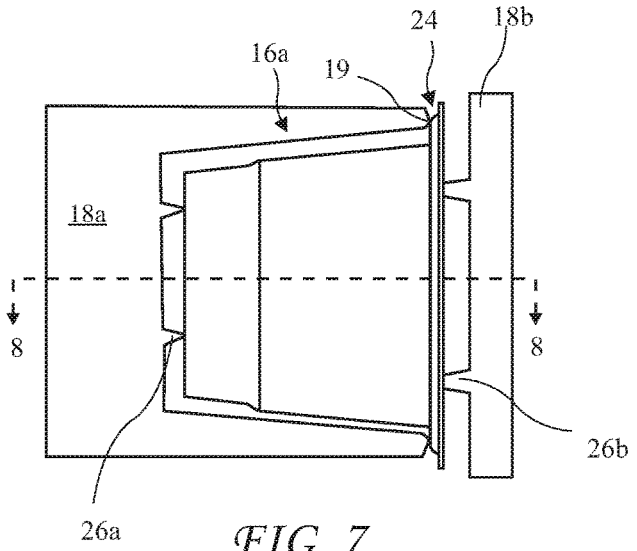
FIG. 7 shows the espresso cartridge according to the present invention in the brewing chamber before the brewing chamber is completely closed.
Figure 8:
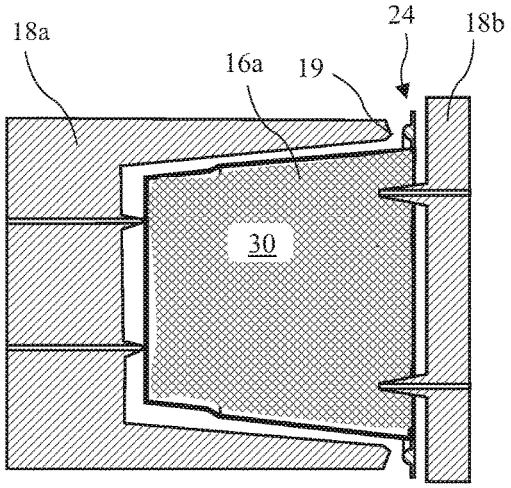
FIG. 8 shows a cross-sectional view of the espresso cartridge according to the present invention in the brewing chamber before the brewing chamber is completely closed, taken along line 8-8 of FIG. 7.

The espresso cartridge 16*a* is shown in the brewing chamber 18 before the brewing chamber 18 is completely closed in FIG. 7, and a cross-sectional view of the espresso cartridge 16*a* in the brewing chamber 18 before the brewing chamber 18 is completely closed, is shown in FIG. 8 taken along line 8-8 of FIG. 7. The contour 24 of the espresso cartridge 16*a* is shown aligned with the raised edge 19 of the brewing chamber base 18*a*. The espresso cartridge 16*a* includes a portion of the brewing material 30. The brewing material 30 is preferably finely ground espresso brewing material.

Figure 9:
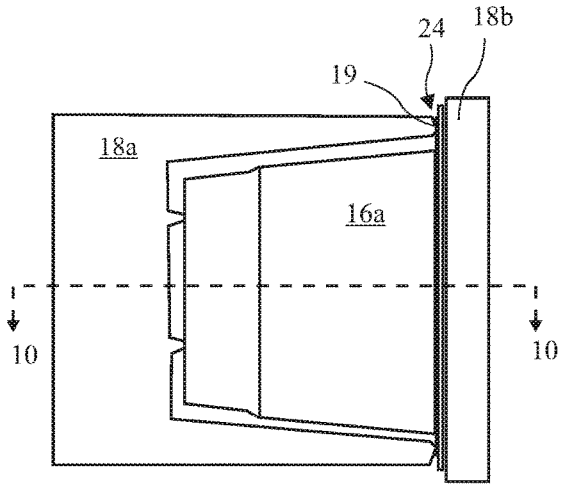
FIG. 9 shows the espresso cartridge according to the present invention in the brewing chamber after the brewing chamber is completely closed.
Figure 10:
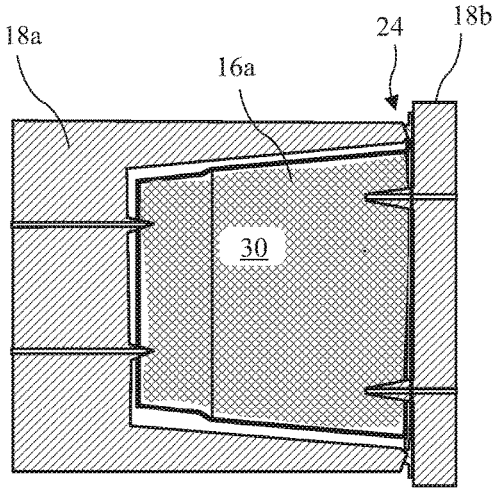
FIG. 10 shows a cross-sectional view of the espresso cartridge according to the present invention in the brewing chamber after the brewing chamber is completely closed, taken along line 10-10 of FIG. 9.

The espresso cartridge 16*a* is shown in the brewing chamber 18 after the brewing chamber 18 is completely closed in FIG. 9 and a cross-sectional view of the espresso cartridge 16*a* in the brewing chamber 18 after the brewing chamber 18 is completely closed, is shown in FIG. 10 taken along line 10-10 of FIG. 9. The raised edge 19 of the brewing chamber base 18*a* is seen to crush the contour 24 of the espresso cartridge 16*a* to seal the brewing chamber 18. The espresso cartridge 16*a* includes a portion of the espresso brewing material 30.

Figure 11:
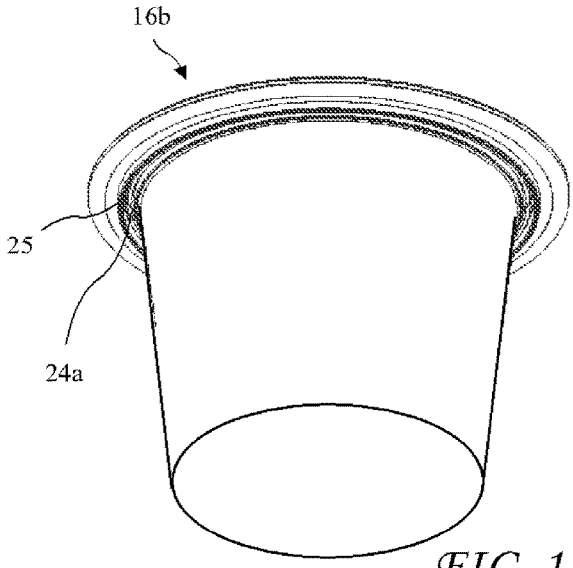
FIG. 11 shows a bottom side perspective view of a second espresso cartridge according to the present invention.
Figure 12:
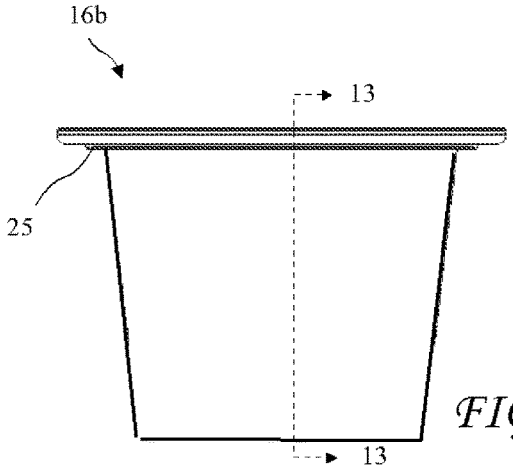
FIG. 12 shows a side view of the second espresso cartridge according to the present invention.
Figure 13:
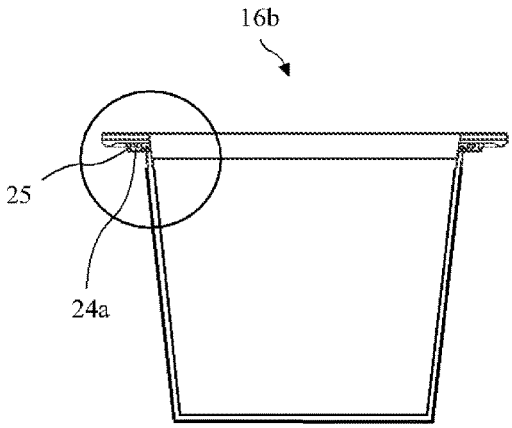
FIG. 13 shows a cross-sectional view of the second espresso cartridge according to the present invention taken along line 13-13 of FIG. 12.
Figure 14:
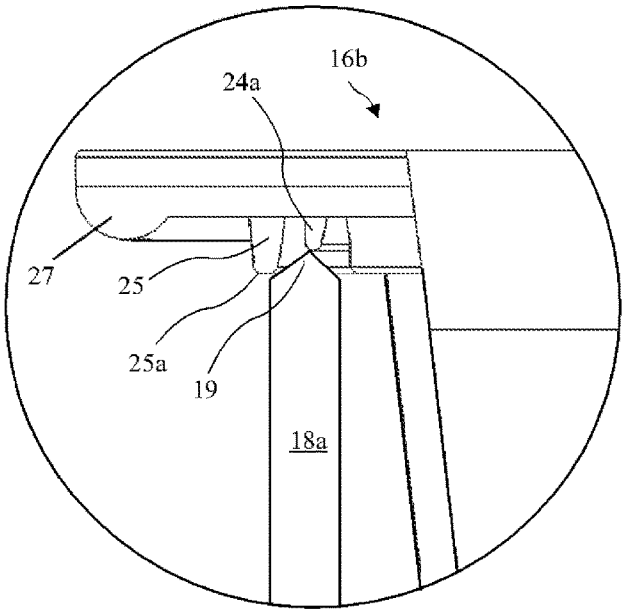
FIG. 14 shows detail 14 of FIG. 13 showing a partial cross-sectional view of the second espresso cartridge according to the present invention.

A bottom side perspective view of a second espresso cartridge 16*b* according to the present invention is shown in FIG. 11, a side view of the second espresso cartridge 16*b* is shown in FIG. 12, a cross-sectional view of the second espresso cartridge 16*b* taken along line 13-13 of FIG. 12 is shown in FIG. 13, and a detail 14 of FIG. 13 showing a partial cross-sectional view of the second espresso cartridge 16*b* is shown in FIG. 14. The second espresso cartridge 16*b* is similar to the espresso cartridge 16*a*, but includes a centering contour 25 outside a second sealing contour 24*a*. The sealing contour 24*a* is aligned with the raised edge 19 of the brewing chamber base 18*a* to at least partially crush the contour 24*a* of the espresso cartridge 16*b* to seal the brewing chamber 18. As shown, the cartridge lid rim includes a lip 27 extending away from the surface of the cartridge lid 22*b* at an outermost perimeter of the cartridge lid 22*b*.

The centering contour 25 has a radius different from the raised ridge 19 of the brewing chamber 18 and further includes a peak 25*a* radially offset from the raised ridge 19 of the brewing chamber base 18*a* and contacts the raised edge 19 of the brewing chamber base 18*a* to assist in centering the brewing cartridge 16*b* in the brewing chamber 18 to better align the sealing contour 24*a* with the raised edge 19 of the brewing chamber base 18*a*, thus providing an improved sealing of the brewing chamber 18. The centering contour 25 preferably extends farther towards the raised edge 19 of the brewing chamber base 18*a* to contact the raised edge 19 of the brewing chamber base 18*a* before the raised edge 19 of the brewing chamber base 18*a* contacts the sealing contour 24*a*.

While the centering contour 25 is shown outside the sealing contour 24*a*, those skilled in the art will recognize that a centering contour may reside inside the sealing contour 24*a* to align the sealing contour 24*a* with the raised edge 19, and an espresso cartridge having a centering contour inside the sealing contour is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. An espresso cartridge, comprising:

a cartridge base configured as a container having an opening, wherein the opening is defined by an edge of the cartridge base; and a cartridge lid having a first surface, wherein the first surface of the cartridge lid is attached to the edge of the cartridge base, thereby covering the cartridge base opening;

wherein the cartridge lid includes a cartridge lid rim extending beyond the cartridge base edge and forming a periphery of the cartridge lid outside the cartridge base edge: and wherein the cartridge lid rim includes a lip extending away from the first surface of the cartridge lid at an outermost perimeter of the cartridge lid;

a sealing contour arranged on the first surface of the cartridge lid rim, extending away from the first surface; and a centering contour arranged on the first surface of the cartridge lid, extending away from the first surface and configured to contact a raised edge and to align the sealing contour toward the raised edge;

wherein the lip, the sealing contour, and the centering contour are the only raised features on the first surface, which is otherwise flat.

2. The espresso cartridge of claim 1, wherein the sealing contour forms a continuous closed ring around the first surface of the cartridge lid.

3. The espresso cartridge of claim 1, wherein the sealing contour is configured to be at least partially crushed by the raised edge when the sealing contour is pressed against the raised edge.

4. The espresso cartridge of claim 1, wherein the centering contour is arranged closer to the outermost perimeter of the cartridge lid than is the sealing contour.

5. The espresso cartridge of claim 1, wherein the centering contour is inside the sealing contour.

6. The espresso cartridge of claim 1, wherein the centering contour is arranged concentric with the sealing contour.

7. The espresso cartridge of claim 1, wherein the centering contour extends farther away from the first surface of the cartridge lid than does the sealing contour.

8. The espresso cartridge of claim 1, wherein the cartridge base is configured to contain ground coffee beans.

9. The espresso cartridge of claim 8, wherein the cartridge base is configured to contain a measured portion of the ground coffee beans.

10. The espresso cartridge of claim 1, wherein the first surface of the cartridge lid is flat between the sealing contour and the edge of the cartridge base.

11. An espresso cartridge, comprising:

a container having an opening, wherein the opening is defined by an edge of the cartridge base; and a lid having a first surface, wherein the first surface of the lid is attached to the edge of the container, thereby covering the container opening;

wherein the lid includes a rim extending beyond the container edge and forming a periphery of the lid outside the cartridge base edge; and wherein the rim includes a lip extending away from the first surface at an outermost perimeter of the lid;

an annular sealing contour arranged on the first surface of the lid, extending away from the first surface; and an annular centering contour, arranged on the first surface of the lid and concentric with the annular sealing contour, extending away from the first surface and configured to contact a raised edge and to align the annular sealing contour toward the raised edge, wherein the annular centering contour is further configured such that the annular centering contour extends away from the first surface a greater distance than the annular sealing contour extends from the first surface;

wherein the lip, the annular sealing contour, and the annular centering contour are the only raised features on the first surface, which is otherwise flat.

12. The espresso cartridge of claim 11, wherein the annular sealing contour is configured to be at least partially crushed by the raised edge when the annular sealing contour is pressed against the raised edge.

13. The espresso cartridge of claim 11, wherein the container is configured to contain ground coffee beans.

14. The espresso cartridge of claim 13, wherein the container is configured to contain a measured portion of the ground coffee beans.

15. The espresso cartridge of claim 11, wherein the first surface of the lid is flat between the annular sealing contour and the edge of the container.

16. The beverage brewing cartridge of claim 11, wherein the annular centering contour has a larger diameter than that of the annular sealing contour.

17. A beverage brewing cartridge including means for sealing against a raised edge of a brewing machine, the beverage brewing cartridge comprising:

container means for containing a measured quantity of ground brewing material, the container means having an opening, wherein the opening is defined by a container means edge; and covering means, having a first surface, for covering the container means opening such that the first surface of the covering means seals the container means edge;

wherein the covering means includes a rim that extends beyond the container means edge and forms a periphery of the covering means outside the container means edge; and wherein the rim of the covering means includes lip means extending away from the first surface at an outermost perimeter of the covering means;

annular sealing means for sealing against the raised edge, arranged on the first surface of the covering means within the periphery of the covering means, extending away from the first surface; and annular centering means, arranged concentric with the annular sealing means, extending away from the first surface for contacting the raised edge and to position the annular sealing means against the raised edge, wherein the annular centering means is further configured such that the annular centering means extends away from the first surface a greater distance than the annular sealing means extends from the first surface;

wherein the lip means, the annular sealing means, and the annular centering means are the only raised features on the first surface, which is otherwise flat.

18. The beverage brewing cartridge of claim 17, wherein the annular sealing means is configured to be at least partially crushed by the raised edge when the annular sealing means is pressed against the raised edge, thereby providing a seal between the raised edge and the periphery.

19. The beverage brewing cartridge of claim 17, wherein the first surface of the covering means within the periphery is flat between the annular sealing means and the container means edge.

20. The beverage brewing cartridge of claim 17, wherein annular centering means has a larger diameter than that of the annular sealing means.

* * * * *